US005704447A

United States Patent [19]

Doyle

[11] Patent Number: 5,704,447

[45] Date of Patent: Jan. 6, 1998

[54] SNAP-IN, ROPE LOOP STEP PAD

[76] Inventor: David A. Doyle, 84-770 Kili Dr. #1038, Makaha, Hi. 96792

[21] Appl. No.: 442,394

[22] Filed: May 16, 1995

[51] Int. Cl.[6] ..... F04G 3/00; E06C 9/00; E06C 1/52; E06C 5/26

[52] U.S. Cl. ..... 182/90; 182/93; 182/196; 182/228

[58] Field of Search ..... 182/90, 92, 93, 182/196, 199, 228

[56] References Cited

U.S. PATENT DOCUMENTS

| | | | |
|---|---|---|---|
| D. 334,731 | 4/1993 | McCarty | D12/317 |
| 1,349,125 | 8/1920 | Full | 182/196 |
| 4,788,926 | 12/1988 | Ullman et al. | 114/219 |
| 5,014,818 | 5/1991 | Shulz | 182/228 |
| 5,074,236 | 12/1991 | Robertson | 114/362 |
| 5,117,942 | 6/1992 | Tzaravas | 182/142 |
| 5,316,409 | 5/1994 | Aune | 405/1 |

FOREIGN PATENT DOCUMENTS

| | | | |
|---|---|---|---|
| 0797813 | 7/1958 | United Kingdom | 182/228 |

OTHER PUBLICATIONS

"Happy's Swim Stirrup", Idea Development Co.; pp. 1–4.

"Emergency Canister Ladder", 2–page brochure, by Quality Marine Products, Inc, Alameda, California.

West Marine Catalog, 1995 General Catalog, pp. 490–493.

*Primary Examiner*—Daniel P. Stodola
*Assistant Examiner*—Matthew A. Kaness
*Attorney, Agent, or Firm*—Ray K. Shahani

[57] ABSTRACT

An individual step pad which can be incorporated into any loop of rope or dock line. The step pad provides a permanent or temporary rescue and utility footing in combination with a piece of rope. The step pad comprises a step pad portion, the step pad portion having a generally flat upper surface, a lower surface, upper edges, a predetermined thickness and lengthwise ends. The step pad portion further has two rope receiving notches in the lengthwise ends each consisting of a semi-circular groove extending vertically through the step pad, the semi-circular groove having a predetermined diameter, whereby the piece of rope is captured within the semi-circular groove of the notches on either end of the step pad. The device is portable and can float, and when installed in a loop of rope, can be thrown to a person in the water or in another boat, etc. The device can accommodate ropes or dock lines of different sizes, the device being secured at either end by a rope of a predetermined size fitted into one of the rope notches at either end of the device, rendering the device infinitely adaptable to ropes of various operative dimensions. A method for using the step pad is also disclosed.

5 Claims, 2 Drawing Sheets

SNAP-IN, ROPE LOOP STEP PAD

FIELD OF THE INVENTION

This invention relates to step pads and, more particularly, to emergency ladders, rope ladders, and other rescue and utility devices. The invention is essentially an individual step which can be incorporated into any loop of rope or dock line. The device is portable and can float, and when installed in a loop of rope, can be thrown to a person in the water or in another boat, etc. The device can accommodate ropes or dock lines of different sizes, the device being secured at either end by a rope of a predetermined size fitted into one of the rope notches at either end of the device, rendering the device infinitely adaptable to ropes of various operative dimensions.

BACKGROUND OF THE INVENTION

A variety of various types of devices and systems have been described in the prior art related to ladders of various types.

U.S. Pat. No. 4,788,926, class 114/219 issued Dec. 6, 1988 to Ullman et at. This device is a boat fender which is provided with footstep or handgrip openings at its top and bottom to serve as a ladder for assisting an overboard person. The fender may be made of two separable members such that a folded rope ladder is stored within.

U.S. Pat. No. 5,074,236, class 1114/362 issued Dec. 24, 1991 to Robertson. This device is a canister contained emergency boat ladder with a flexible leader attached to the boat. A lanyard hangs from the canister and a pull on the lanyard causes the canister to open and the ladder to fall out into an operable position.

U.S. Pat. No. 5,117,942, class 182/142 issued Jun. 2, 1992 to Tzavaras. This apparatus for suspending a person above ground, such as a hunter, includes a base with a canopy. A pulley system attaches to the top of the canopy and, when operated, moves the base and canopy portion up and down as controlled by the individual being raised or lowered.

U.S. Pat. No. 5,316,409, class 405/1 issued May 31, 1994 to Aune. This articulated, portable boat skidway is provided by combining lengths of steel rods interconnected by flexible joints in a ladder-like array.

U.S. Pat. No. Des. 334,731, class D12/317 issued Apr. 13, 1993. This design for a boat boarding ladder consists of tubular rod members with foot pads mounted thereon and a hook portion for suspending the device from the side of a boat.

Applicant is aware of a product on the market known as "Swim Stirrup". This product is essentially a single-step rope ladder. An obvious shortcoming of this standard device is that the strength of the step is determined by the material and design of construction. In the present invention, as the rope travels underneath the step pad, the maximum strength of the step pad becomes that of the rope, the only limiting factor in various embodiments.

Applicant is also aware of a product marketed as "Emergency Canister Ladder" made by Quality Marine Products Inc. of Alameda, Calif. This invention is an emergency device with a rope which, when withdrawn from the canister, causes a rope ladder to tumble out and fall into place for use.

It is an object of this invention to provide a device which is portable. It is a further object of this invention to provide a light-weight, inexpensive device which can be used by any boater or sportsman or other individual with a length of rope of nearly any diameter. It is a further object of this invention to provide a device which, when assembled with a minimum mount of work, can be thrown or tossed to an individual in the water or at some other position. The invention will be utilitarian for a wide range of uses, including boating, swimming, construction, vehicle emergency supplies, painting, etc.

SUMMARY OF THE INVENTION

The present invention is a step pad which provides a permanent or temporary rescue and utility footing in combination with a piece of rope. The step pad comprises a step pad portion, the step pad portion having a generally flat upper surface, a lower surface, upper edges, a predetermined thickness and lengthwise ends. The step pad portion further has two rope receiving notches in the lengthwise ends each consisting of a semi-circular groove extending vertically through the step pad, the semi-circular groove having a predetermined diameter, whereby the piece of rope is captured within the semi-circular groove of the notches on either end of the step pad.

A preferred embodiment of the step pad has rope receiving notches which consist of a plurality of smallest and larger diameter concentric and offset semi-circular grooves extending vertically through the step pad, the smallest diameter grooves closest to the center of the step pad and the larger diameter grooves overlapping with the smallest diameter groove and with each other becoming increasingly larger in diameter toward the lengthwise ends. Preferred embodiments will be made of one or more materials in the set consisting of metal, wood, robber, polymers, plastics and composites. The invention of claim 2 wherein the diameters of the grooves correspond with standard rope diameters, such as ⅜ inch, ½ inch and ⅝ inch.

A method of using a ladder step as described above includes the following steps:

(a) obtain a step pad as described above;

(b) obtain an operatively sized piece of rope having at least a first end and a second end;

(c) form a non-slipping loop in the first end of the piece of rope;

(d) juxtapose the step pad within the loop of rope such that the loop is disposed within the rope-receiving end notches and the rope is captured within the grooves of the notches;

(e) secure the second end of the rope to a structure such that the step pad disposed within the loop of rope hangs at an operative height; and (f) apply force to the top surface of the step pad, thereby loading the step pad with the weight of a person or goods so as to effect a transfer of the person or goods between two points.

Numerous other advantages and features of the present invention will become readily apparent from the following detailed description of the invention and the embodiments thereof, from the claims and from the accompanying drawings in which the details of the invention are fully and completely disclosed as a part of this specification.

DETAILED DESCRIPTION OF THE INVENTION

Figure 1:
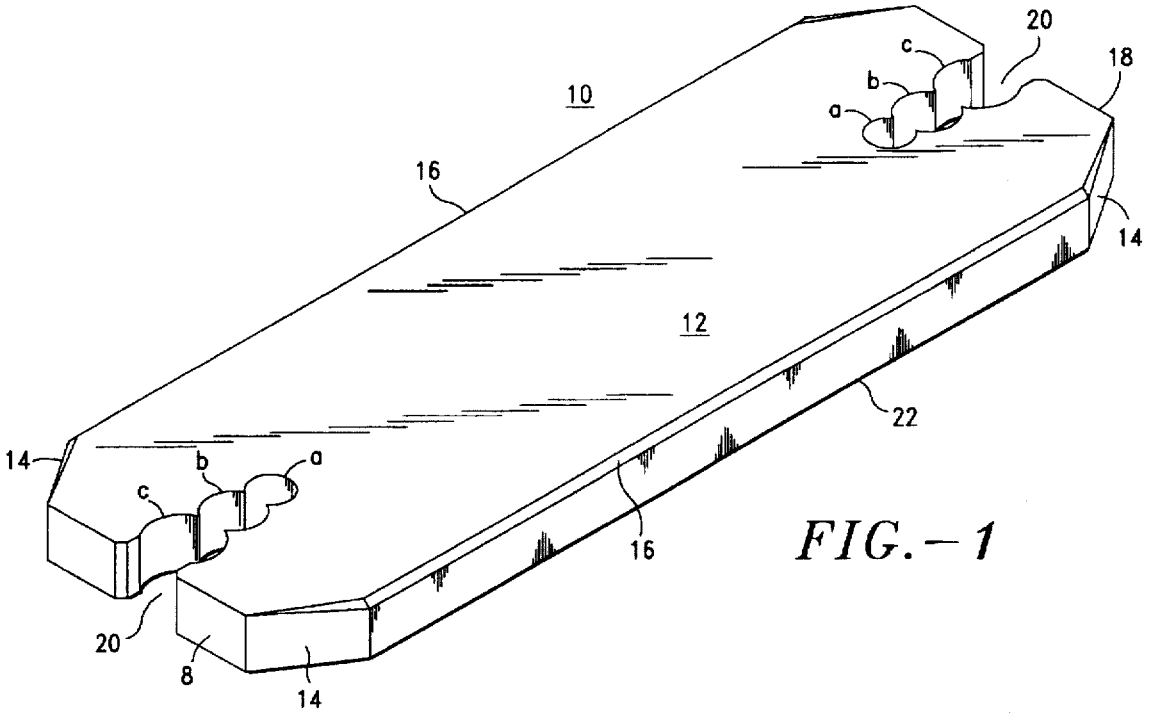
FIG. 1 is a left front top perspective view of an embodiment of the present invention.

FIG. 1 is a left front top perspective view of an embodiment of the present invention. The step pad portion 10 is essentially flat. The upper surface 12 is intended to bear the weight of the user. The top surface has curved, rounded or blunted comers 14. Furthermore, at least the upper edges 16 can be beveled or rounded to make the step more comfortable when stepped on by bare feet. Other edges could also be beveled or curved. Along both of the lengthwise ends 18, rope notches 20 are centered. These rope notches consist of essentially vertical cuts in the step pad. As shown, a series of three, increasing diameter semi-circular grooves a, b and c extend from the top surface of the step pad vertically through the step to the lower surface 22 of the step pad.

Figure 2:
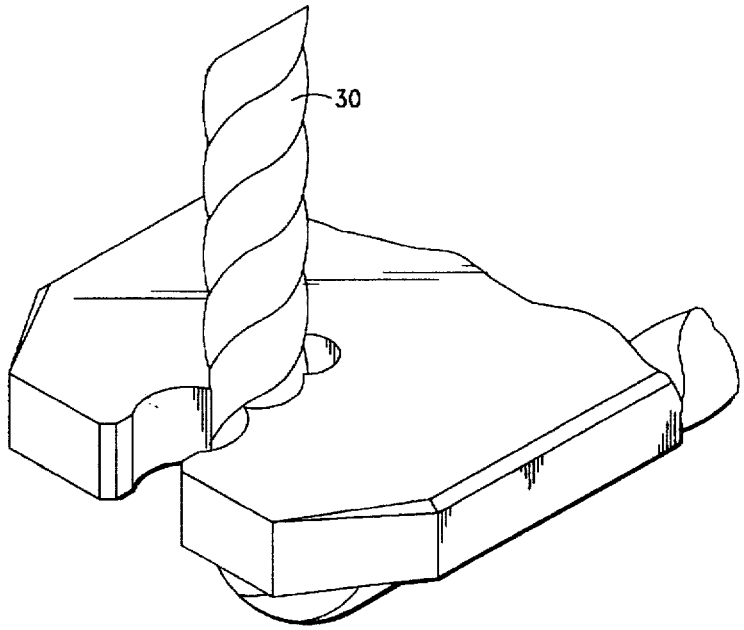
FIG. 2 is a left from top detail perspective view of an embodiment of the present invention.

FIG. 2 is a left front top detail perspective view of an embodiment of the present invention. As shown, when the device is to be used, a section of rope or dock line 30 can be fitted through the rope notches. The rope would extend from the top of the step pad through the rope notch and along the underside of the device. As shown, the rope would become wedged into two equally dimensioned semicircular grooves at either end of the step pad. In this manner, the device can be used in conjunction with ropes or dock lines of varying dimensions. Typically, the most popular sizes of dock lines used by the recreational boater are ⅜, ½ and ⅝ inch. By providing a plurality of different sized circular grooves extending through the step pad, the inserted rope actually will become wedged into the appropriate sized groove.

As will become apparent to those skilled in the art, the requirement for more than one sized semicircular groove at either end of the step pad is chiefly for convenience. Alternate embodiments could be manufactured with grooves at either end of the step which would accommodate a rope of only one, predetermined diameter. In these embodiments, the operation of the device would be very similar, with the exception of providing a device LESS adaptable or not adaptable at all to ropes or dock lines of varying diameters. It has been determined that providing a device with the ability to be used with virtually any sized rope or dock line is more marketable and will provide more of an all-purpose, rescue or emergency step pad.

Figure 3:
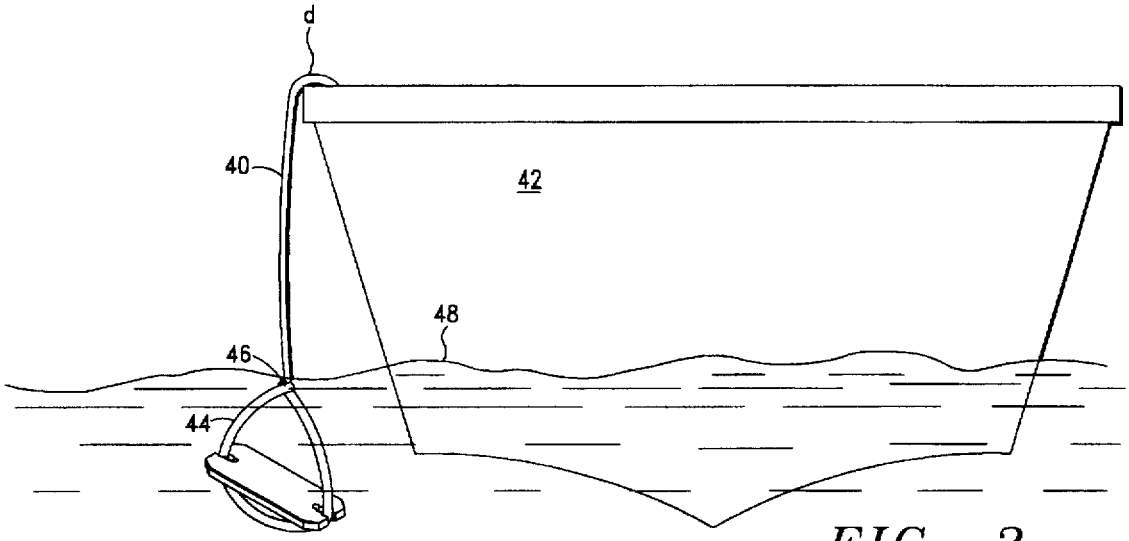
FIG. 3 is a perspective view of an embodiment of the present invention showing a method of use wherein the device is inserted into a loop of rope or dock line.

FIG. 3 is a perspective view of an embodiment of the present invention showing a method of use wherein the device is inserted into a loop of rope or dock line. In this view, the rope 40 is shown extending from the side of a boat 42. The rope could also simply be cleated at one end on the deck at or near a point d of a boat or could originate from within a storage area in the boat. A loop 44 is made in the rope with a knot or other connection 46 between one end of the rope and the rest of it. When the step pad is placed inside the loop and the loop of rope tightened, the grooved ends of the step pad will capture and engage the rope loop, being supported underneath by the lower surface of the step pad. In this manner, a stirrup-type step is provided. The water line is indicated as 48.

Figure 4:
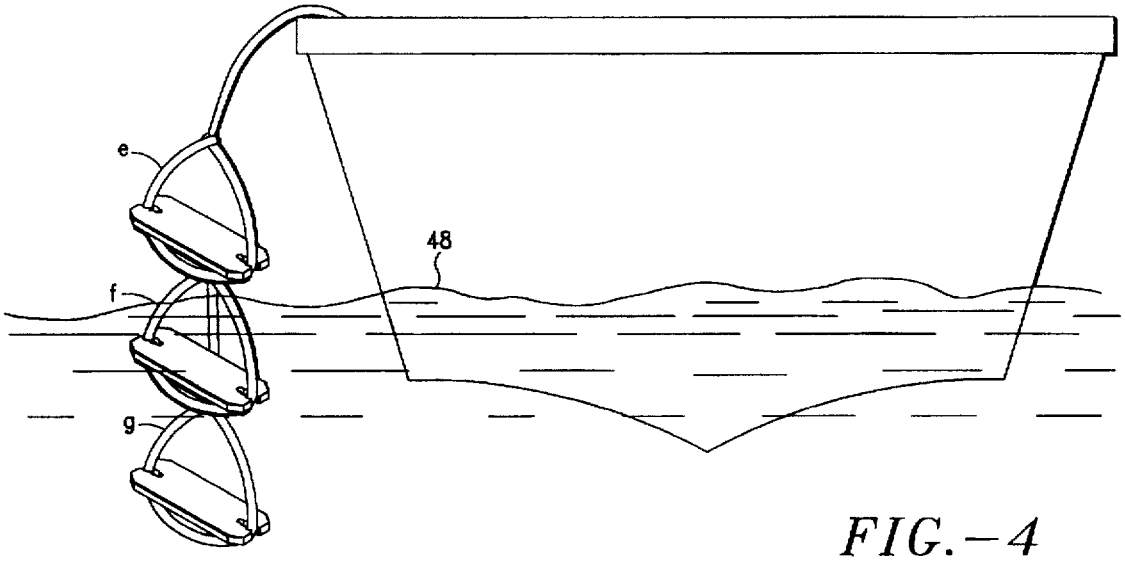
FIG. 4 is a perspective view of an embodiment of the present invention showing a method of use wherein several of the devices are inserted into a series of loops of rope or dock line.

FIG. 4 is a perspective view of an embodiment of the present invention showing a method of use wherein several of the devices are inserted into a series of loops of rope or dock line. It will be understood that a plurality of loops e, f and g can be provided at one end of any rope. Thus, a multi-step rope ladder can be created.

It will be obvious to those skilled in the art that the present invention will be a valuable part of boating and rescue equipment. From any adequately sized piece of rope or dock line, a temporary or permanent ladder can be constructed. All that is required is to be able to form a loop in a piece of rope. The loop, optimally will not slip. Furthermore, the loop of rope need not be at the end of the piece of rope being used—any section of rope can be looped and knotted. As long as the user can put his or her foot into the loop and stand on the step pad, the device will be useful.

It will be apparent to those skilled in the art that it is not necessary to provide a loop of rope to use the present invention. In the case where two pieces of rope are available, simply securing or attaching the two ropes (or two ends of a single rope) to a structure will provide two leading edges for the rope. Then, a knot can be applied to each or the ropes at predetermined, identical heights below the points of attachment. In this manner, the device can be slipped onto the ropes and the device is prevented from sliding down the rope sections due to the knot underneath the semi-circular groove in the notches at the ends of the device. In this method of use, the device is supported in a fashion similar to most common rope ladders which employ an appropriately sized knot underneath the individual steps of the ladder to prevent the steps from sliding down under the weight of the user. The novelty of the present invention, however, is apparent. This type of ladder can be made easily and economically without the need to thread the ropes through the steps, knot the ropes, etc.

The invention is particularly useful in transfer of people or other goods between boats, such as from a Zodiac (trademark) type inflatable raft or dinghy to a larger sailboat. It can also serve to assist in positioning a bosun's chair or trapeze. Inserted into a loop of operatively sized rope, the device, acting as a ballast, can be swung through the air to effect it's conveyance to an individual in water in or in other rescue operations. The step can also find application in other nautical environments, hunting, fishing, mountain climbing, games, industrial use, construction, painting, rescue equipment, etc. Additional uses of this invention include hoisting people or objects up structures or out of holes, storing the device in automobiles and other vehicles for emergency uses, providing work and construction crews with the a portable step, assisting tree trimmers, lighting and scaffolding technicians, etc.

The step pad of the present invention can be made out of virtually any suitable material. Such materials would optimally be waterproof, not too heavy so as to permit portability and operability, but not too lightweight to prevent being able to throw the device, attached to a rope, to a person in water to effect a rescue or other operation. It could also be valuable to construct the step pad from materials that float. Suitable materials include metal, wood, rubber, polymers, plastics or composites. The manufacturing process could include molding, casting, carving, extruding. A knurled or otherwise patterned or textured finish could be applied to the top surface, end surfaces to improve the gripping ability of bare feet, wet shoes, etc. of the user.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, with the limits only of the true spirit and scope of the invention.

I claim:

1. A permanent or temporary rescue and utility stirrup comprising, in combination:

a step pad with a homogenous construction having:

a generally flat upper surface with a predetermined width and a predetermined length, the predetermined width and predetermined length suitable for gasping manually and for standing upon;

a lower surface;

a predetermined thickness; and two ends, the two ends each having a rope receiving notch consisting of a semi-circular groove of a predetermined diameter extending between the upper surface and the lower surface through the step pad;

a loop of rope, wherein the step pad is positioned inside the loop of rope with the rope captured and engaged within the semi-circular groove of the rope receiving notches.

2. The step pad of claim 1 wherein the step pad is made of one material in the set of materials consisting of metal, wood, robber, polymer, plastic and composite.

3. The step pad of claim 1 wherein the diameters of the grooves correspond with standard rope diameters, including ⅜ inch, ½ inch and ⅝ inch.

4. The step pad of claim 1 wherein the rope receiving notch on each end consists of a plurality of semi-circular grooves, the plurality of semi-circular grooves defining an opening in each of the two ends of the step pad, the opening in each of the two ends having a predetermined diameter, each semi-circular groove having different diameters and concentricities, whereby the grooves overlap, and are arranged so that the smaller diameter grooves are inside the larger diameter grooves, with respect to the predetermined length of the step pad, wherein when positioned inside a loop of rope with the length of the step pad essentially parallel to the plane of the loop, the loop of rope will engage at least one of the plurality of semi-circular grooves of the rope receiving notch on each end of the step pad and hold it in operative place within the loop of rope.

5. A method of constructing a permanent or temporary stirrup support, the stirrup support comprising a step pad with a homogeneous construction having a generally flat upper surface, a lower surface, a predetermined width and a predetermined length, the width and length suitable for grasping manually and for standing upon, the step pad having a rope receiving notch at each lengthwise end consisting of a plurality of semicircular grooves, the plurality of semi-circular grooves defining an opening of the notches, each semicircular groove having progressively smaller concentricities, the grooves overlapping with the smaller diameter grooves inside the larger diameter grooves, the method including the following steps:

(a) creating a loop with a rope, the loop having a diameter about the length of the step pad;

(b) positioning the step pad within the loop of rope with the respective notches receiving the rope such that at least one of the plurality of semi-circular grooves engages the rope.

* * * * *